US007118103B2

(12) United States Patent
Greive

(10) Patent No.: US 7,118,103 B2
(45) Date of Patent: Oct. 10, 2006

(54) DEVICE FOR CONVEYING SHEETS THROUGH A PRINTING MACHINE

(75) Inventor: Martin Greive, Schönau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 43 days.

(21) Appl. No.: 10/801,964

(22) Filed: Mar. 15, 2004

(65) Prior Publication Data

US 2004/0201168 A1 Oct. 14, 2004

(30) Foreign Application Priority Data

Apr. 14, 2003 (DE) ..... 103 17 125

(51) Int. Cl.

| | |
|---|---|
| ***B65H 5/02*** | (2006.01) |
| ***B65H 29/32*** | (2006.01) |
| ***B65H 3/14*** | (2006.01) |
| ***B65H 13/02*** | (2006.01) |
| ***D21F 3/10*** | (2006.01) |
| ***B41J 25/308*** | (2006.01) |

(52) U.S. Cl. ..... 271/275; 271/98; 271/196; 271/197; 271/258.01; 271/265.04; 198/689.1; 347/8; 347/104; 162/369

(58) Field of Classification Search ..... 347/8, 347/104; 271/98, 196, 197, 265.04, 258.01; 162/369; 198/689.1

See application file for complete search history.

(56) References Cited

U.S. PATENT DOCUMENTS

| | | | | |
|---|---|---|---|---|
| 2,879,696 | A * | 3/1959 | Cox | 162/391 |
| 4,469,026 | A | 9/1984 | Irwin | |
| 5,305,869 | A * | 4/1994 | Damkjaer | 198/689.1 |
| 5,524,676 | A * | 6/1996 | Scorl et al. | 139/1 C |
| 5,526,105 | A * | 6/1996 | Kenin et al. | 399/381 |
| 5,613,675 | A * | 3/1997 | Kruger et al. | 271/270 |
| 5,697,606 | A * | 12/1997 | Maass | 271/197 |
| 5,810,350 | A * | 9/1998 | Pollich | 271/276 |
| 5,854,643 | A * | 12/1998 | Katsuyama | 347/8 |
| 5,992,994 | A * | 11/1999 | Rasmussen et al. | 347/104 |
| 6,032,577 | A * | 3/2000 | Doyle | 101/129 |
| 6,168,260 | B1 * | 1/2001 | Yanagi et al. | 347/37 |
| 6,176,484 | B1 | 1/2001 | Greive et al. | |
| 6,253,674 | B1 * | 7/2001 | Cook | 101/126 |
| 6,254,081 | B1 * | 7/2001 | Rasmussen et al. | 271/96 |
| 6,311,921 | B1 * | 11/2001 | Moller et al. | 242/535.4 |
| 6,547,384 | B1 * | 4/2003 | Hayashi | 347/103 |

(Continued)

FOREIGN PATENT DOCUMENTS

DE 38 38 078 A1 6/1989

(Continued)

*Primary Examiner*—Gene O. Crawford
*Assistant Examiner*—Leslie A. Nicholson, III
(74) *Attorney, Agent, or Firm*—Laurence A. Greenberg; Werner H. Stemer; Ralph E. Locher

(57) ABSTRACT

A device for conveying sheets through a printing machine, in particular through an ink jet printing apparatus, permits adaptation to different printing material thicknesses and ensures reliable transport. The conveying device has a conveyor belt which runs over deflection rollers and guide elements and to which sheets can be fed individually one after another. An apparatus enables setting the distance between the surface to be printed of a sheet and a print head. At least three conveying segments are arranged one after another, the print head being fastened to a holding device opposite a central conveying segment. Each conveying segment is assigned at least one guide element and it is possible to adjust the height of the guide element opposite the print head in accordance with the thickness of the sheets.

3 Claims, 4 Drawing Sheets

U.S. PATENT DOCUMENTS 6,588,954 B1 7/2003 Verhoest et al.

FOREIGN PATENT DOCUMENTS

DE 197 04 003 A1 8/1998
DE 199 01 698 A1 8/1999
EP 1 164 027 A2 12/2001

* cited by examiner

DEVICE FOR CONVEYING SHEETS THROUGH A PRINTING MACHINE

BACKGROUND OF THE INVENTION

Field of the Invention

The invention lies in the printing technology field. More specifically, the invention relates to a device for conveying sheets through a printing machine. The device has a conveyor belt which runs over deflection rollers and guide elements and to which sheets can be fed individually one after another. The device also has an apparatus for setting the distance between the surface to be printed of a sheet and a print head.

German published patent application DE 38 38 078 A1 describes an apparatus for conveying sheets lying in an imbricated stream, i.e., in an overlapped manner, having a conveyor table and endless transport belts driven in a circulating manner. Two suction boxes are arranged under the conveyor table which are in each case connected to a vacuum source and which are connected via suction openings to the underside of the transport belts. The transport belts are formed with suction openings. The conveyor table is configured as a single element with a planar surface. Apart from a vacuum control means, the apparatus has no possibility of adapting to different sheet types and sheet thicknesses. During the transport of thin sheets, there is the danger of the corners of a sheet being curved upward and colliding with a transport apparatus, inspection arrangement or processing apparatus, which are necessarily at a small distance from the printing material surface for operational reasons.

SUMMARY OF THE INVENTION

It is accordingly an object of the invention to provide a conveyor device for conveying sheets through a printing machine, in particular through an ink jet printing apparatus, which overcomes the above-mentioned disadvantages of the heretofore-known devices and methods of this general type and which permits adaptation to different printing material thicknesses and ensures reliable transport.

With the foregoing and other objects in view there is provided, in accordance with the invention, a device for conveying sheets through a printing machine having a print head, the device comprising:

a plurality of deflection rollers and a conveyor belt disposed to run over the deflection rollers, the conveyor belt being configured to receive individual sheets one after another;

three mutually adjacent conveying segments defining a conveying path for the sheets, the conveying segments including a central conveying segment opposite the print head;

at least one guide element assigned to each one of the conveying segments; and an apparatus for adjusting a height of the guide element assigned to the central conveying segment opposite the print head in accordance with a thickness of the sheets, for setting a spacing distance between a surface of a sheet to be printed and the print head.

With the above and other objects in view there is also provided, in accordance with the invention, a sheet-conveying assembly in a printing machine, the device comprising:

a holding device and a head (e.g., a print head, an inspection head, or a similar functional device) mounted to the holding device;

a plurality of deflection rollers and a conveyor belt disposed to run over the deflection rollers, the conveyor belt being configured to receive individual sheets one after another;

three mutually adjacent conveying segments defining a conveying path for the sheets, the conveying segments including a central conveying segment opposite the head;

a guide element disposed at the central conveying segment; and an apparatus for adjusting a spacing distance between the guide element and the head in accordance with a thickness of the sheets, for setting a distance between a surface of a sheet and the head.

According to the invention, sheets are guided individually one after another past a print head for printing, using a conveyor belt. The invention can likewise be used when, instead of a print head or in addition to the print head, an inspection head or some other head is used, which head acts on the sheet mechanically or by means of a field. The conveyor belt runs over a plurality of conveying segments, it being possible for a guide element for the conveyor belt or a sheet to move closer to a print head in a manner corresponding to the thickness of the sheets.

If three conveying segments having three suction boxes which comprise the guide elements for the conveyor belt are arranged along the conveying path, it is possible to provide the central suction box in a vertically adjustable manner. The adjacent suction boxes are connected to the central suction box in an articulated manner and can be pivotably mounted on deflection rollers for the conveyor belt. In the case of thin sheets, the central suction box is set at a higher position and is situated closer to the stationary print head than in the case of thicker sheets. In the case of thin sheets, edges are produced transversely to the transport direction at the boundaries of the conveying segments, over which edges a sheet is conveyed, the lateral edges of the sheet being held down. In the case of thicker sheets, the central suction box is lowered, so that the edges between the suction boxes become flatter or disappear completely. The central suction box can be coupled to a lever mechanism and guided in the vertical direction by rollers.

Other features which are considered as characteristic for the invention are set forth in the appended claims.

Although the invention is illustrated and described herein as embodied in a device for conveying sheets through a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
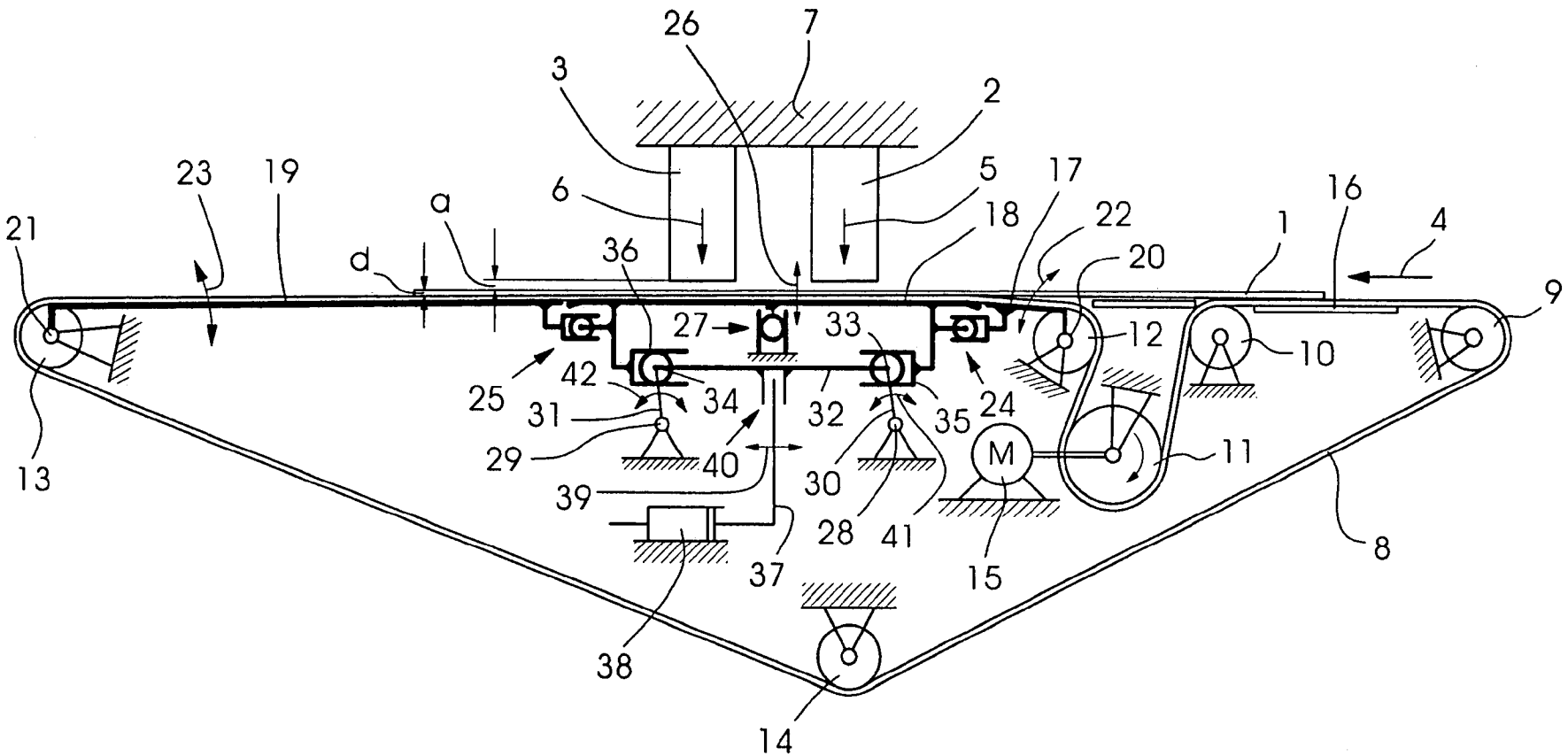
FIG. 1 is a diagram of a device for conveying sheets through an ink jet printing apparatus according to the invention.

Referring now to the figures of the drawing in detail and first, particularly, to FIG. 1 thereof, there is shown a diagram of a device for conveying sheets 1 along ink jet print heads 2, 3. Each ink jet head 2, 3 has rows of nozzles 5, 6 which extend over the entire width of the sheet 1 transversely to the transport direction 4. The ink jet print heads 2, 3 are mounted fixedly on a frame 7. In order to convey the sheet 1, a conveyor belt 8 is provided which is guided over deflection rollers 9–14 arranged fixedly on the frame 7. The deflection roller 11 is coupled to a motor 15. In the conveying path of the sheet 1, the conveyor belt 8 runs over guide elements 16–19, the guide elements 17–19 being combined in constructional terms with suction boxes which are not shown separately in FIG. 1. The guide elements 17, 19 are mounted on the axles 20, 21 of the deflection rollers 12, 13 so as to pivot in the direction of the arrows 22, 23. The guide elements 17, 19 are coupled to the central guide element 18 via joints 24, 25. The guide element 18 can be adjusted in the vertical direction 26 in a linear guide 27. A parallelogram-like mechanism is provided to adjust the height of the guide element 18. Two arms 30, 31, whose ends are connected to a transverse bar 32 in an articulated manner, are disposed on two stationary rotary joints 28, 29. The joints 33, 34 at the end of an arm 30, 31 are enclosed by drivers 35, 36 which are connected to the guide element 18. The transverse bar 32 is connected to the piston of an operating cylinder 38 via a coupling element 37.

When printing is performed using the rows of nozzles 5, 6, the surface of the sheet 1 has to be at a predetermined distance a from the ink jet print heads 2, 3. The height of the guide element 18 is adjusted in accordance with a thickness d of the sheets 1. When pressure is applied to the operating cylinder 38, the coupling element 37 performs a displacement in the horizontal direction 39. This displacement is transmitted to the transverse bar 32 via a joint 40. The arms 30, 31 are pivoted about the rotary joints 28, 29 in the direction of the arrows 41, 42 via the joints 33, 34. As a result, the transverse bar 32 is also moved in the vertical direction 26. This vertical movement of the transverse bar 32 is transmitted to the guide element 18 via the drivers 35, 36.

Figure 2:
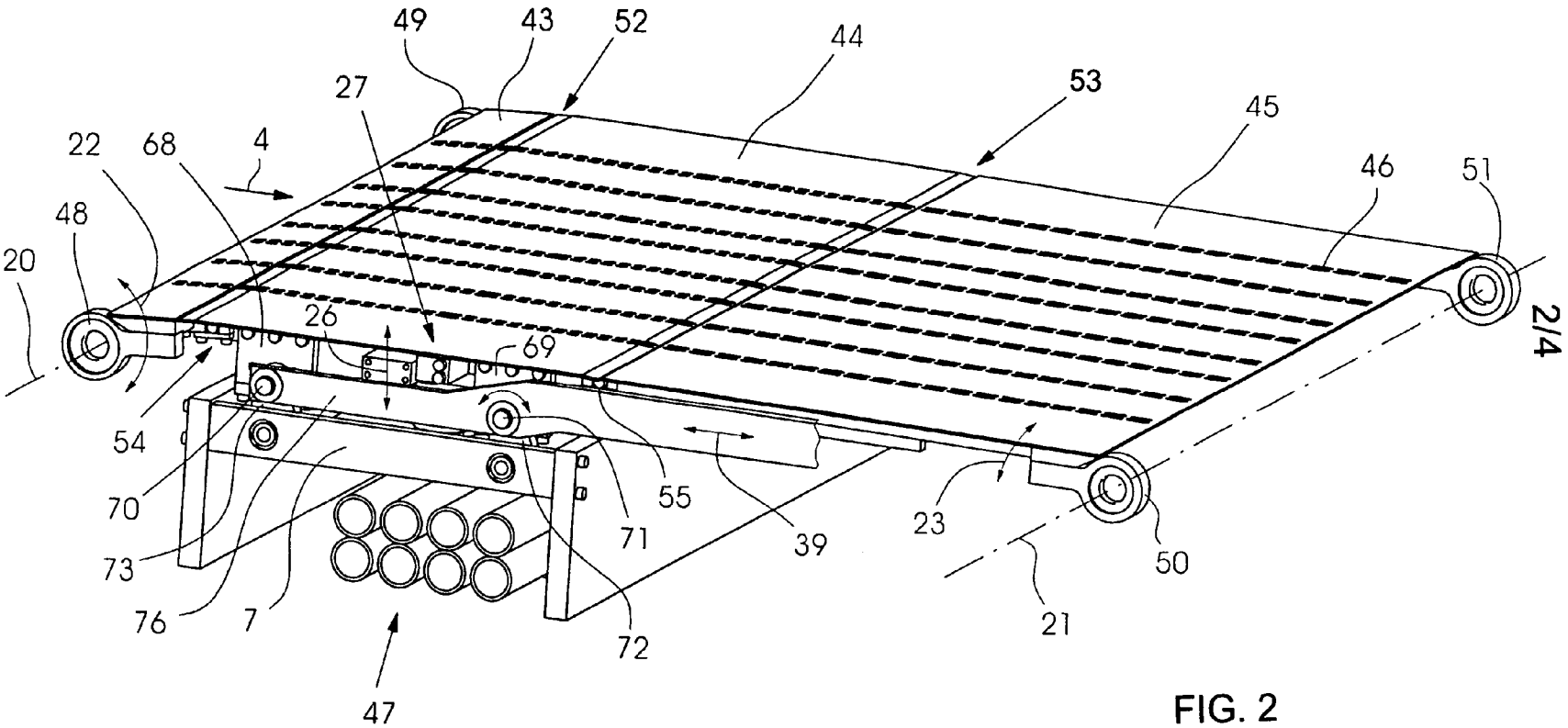
FIG. 2 is a perspective view of three coupled suction boxes.

FIG. 2 shows a perspective illustration of three coupled suction boxes 43–45 which correspond to the guide elements 17–19 according to FIG. 1.

Already-mentioned designations in the following description, refer to identical or functionally equivalent elements of the invention.

The suction boxes 43–45 have rows of holes 46 which are connected to a vacuum source via a line system 47. The rows of holes 46 interact with suction openings in the conveyor belt 8 (not shown in FIG. 2) which glides over the suction boxes 43–45. The suction boxes 43–45 have bearing elements 48–51 which are arranged on the axles 20, 21 of deflection rollers 12, 13 for the conveyor belt 8. When, in the case of thin paper, the suction box 44 is set to a high position using the transverse bar 32, 76, the suction boxes 43, 44 and 44, 45 in each case form edges 52, 53 over which the conveyor belt 8 runs. When a sheet 1 is transported on the conveyor belt 8, the sheet 1 also moves over the edges 52, 53, as a result of which it acquires a certain stability and the side edges of a sheet 1 are not raised. In the case of thicker sheets 1, edges 52, 53 are not formed in such a pronounced manner, which is not disadvantageous because the sheets 1 are then inherently stable.

Figure 3:
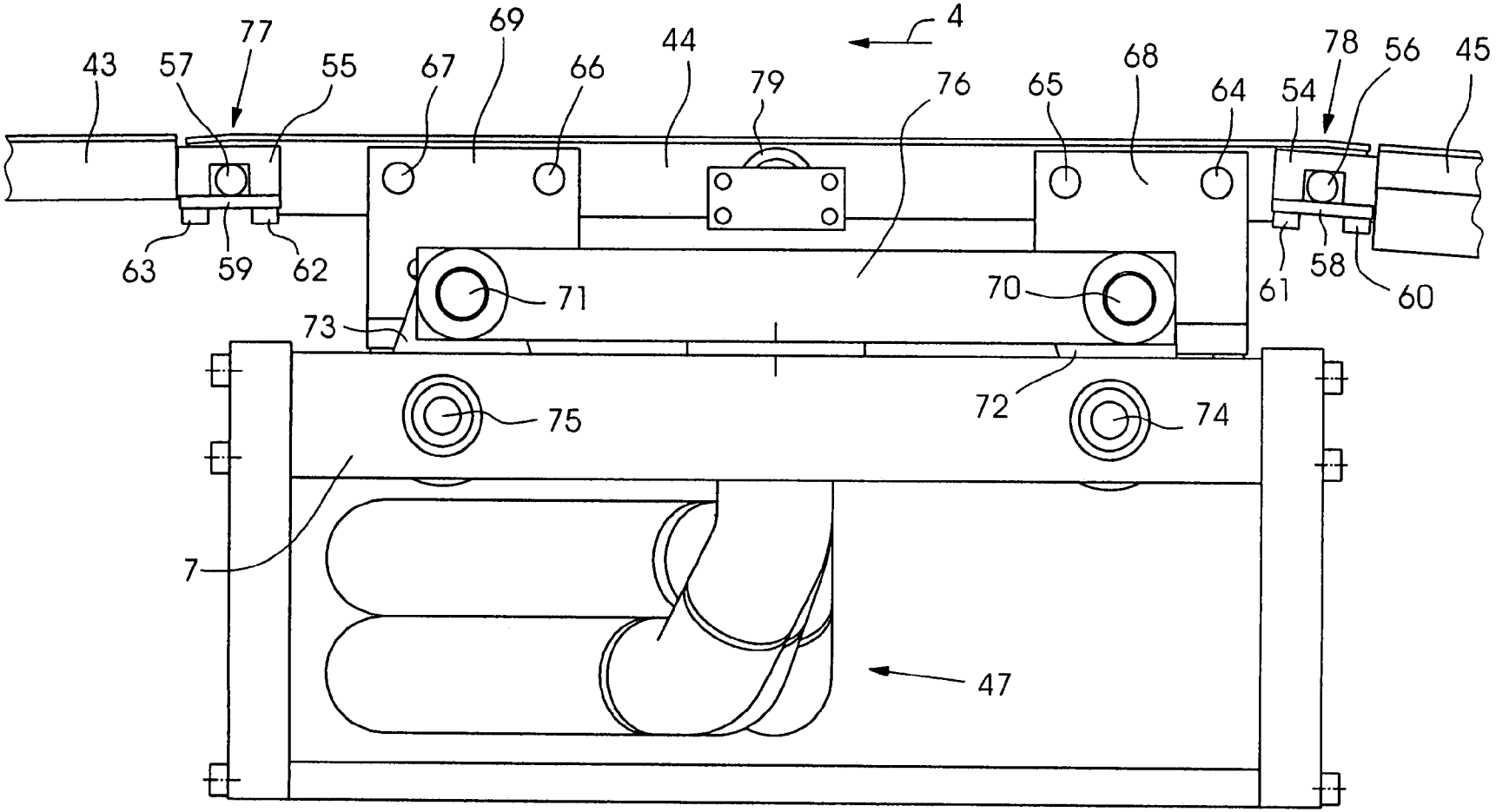
FIG. 3 is a side view of an apparatus for adjusting the height of the central suction box according to FIG. 2.
Figure 4:
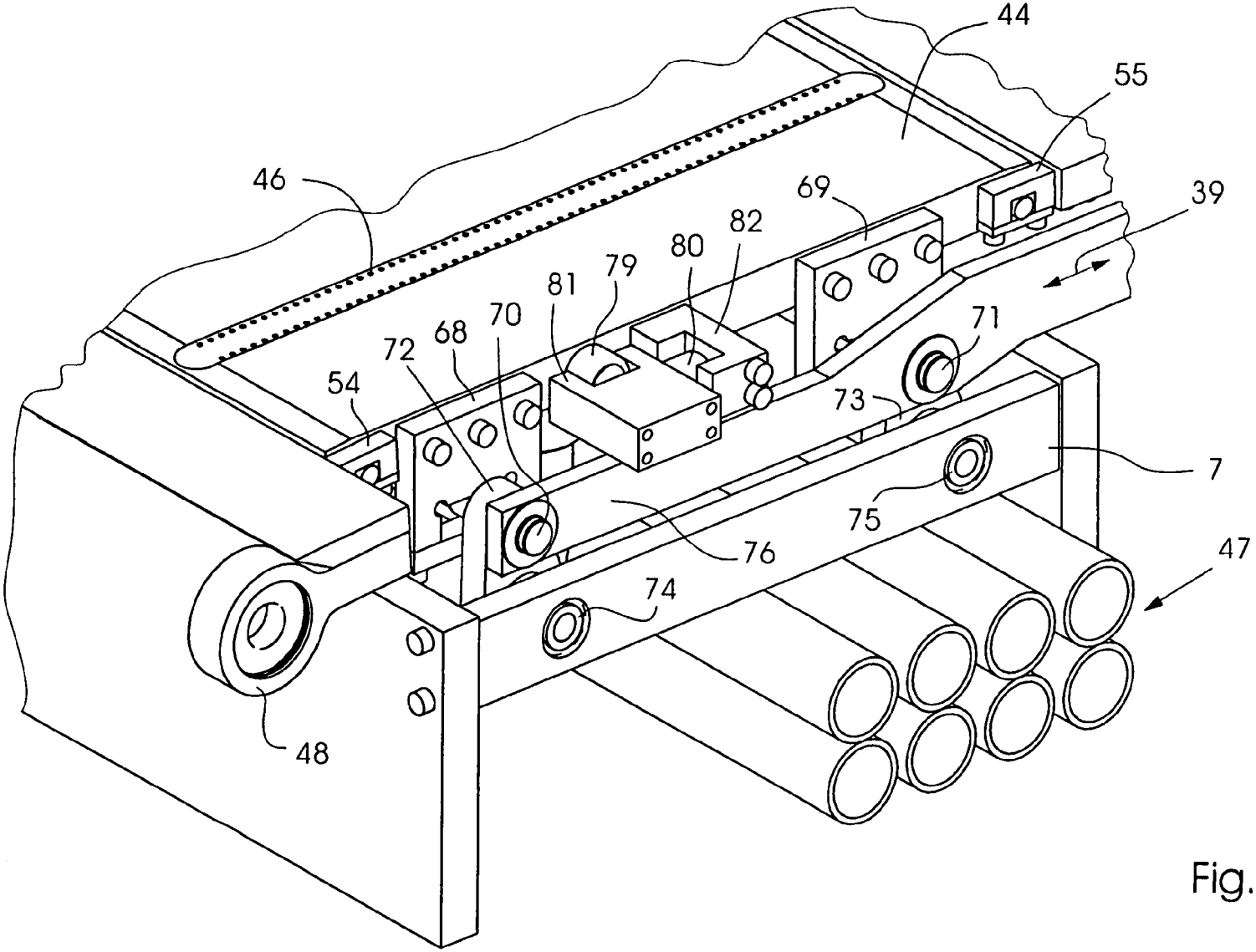
FIG. 4 is a perspective detail view of the vertical guide device for the central suction box according to FIG. 2.

FIGS. 3 and 4 show more details of how the height adjustment of the suction box 44 functions. The suction boxes 43, 45 are mounted on the suction box 44 by means of bearing blocks 54, 55. The bearing blocks 54, 55 enclose bearing pins 56, 57 and are secured with a plate 58, 59 and screws 60–63. L-shaped bearing parts 68, 69 are fastened to the suction box 44 with screws 64–67. The downwardly pointing limbs of the bearing parts 68, 69 engage around pins 70, 71. The pins 70, 71 are arranged at the end of levers 72, 73. The levers 72, 73 are rotatably mounted on pins 74, 75. The pins 74, 75 are fastened to the frame 7. The ends of the levers 72, 73 are connected to a coupler 76 which is extended to one side which is coupled to a control spindle. When the coupler 76 is moved in the horizontal direction 39 using the control spindle, the height of the suction box 44 is changed using the pins 70, 71. The suction boxes 43, 45 then pivot about the axles 20, 21. The bearing blocks 54, 55 on the suction boxes 43, 45 afford enough space for the bearing pins 56, 57 in order to make this pivoting action possible. At the transition to the adjacent suction boxes 43, 45, the guide surface for the conveyor belt 8 on the suction box 44 has slight angled-down regions 77, 78. Running rollers 79, 80 are arranged on the suction box 44 for vertical guidance, said rollers running in guides 81, 82 fixed to the frame. The axles of the running rollers 79, 80 lie in the transport direction 4 and transverse to it. The elements for vertical adjustment and guidance are provided on both sides of the suction box 44.

This application claims the priority, under 35 U.S.C. § 119, of German patent application No. 103 17 125.8, filed Apr. 14, 2003; the entire disclosure of the prior application is herewith incorporated by reference.

I claim:

1. A device for conveying sheets through a printing machine having a print head, the device comprising:

a plurality of deflection rollers and a conveyor belt disposed to run over said deflection rollers, said conveyor belt being configured to receive individual sheets one after another;

three mutually adjacent conveying segments defining a conveying path for the sheets, said conveying segments including a central conveying segment opposite the print head;

three suction boxes each disposed at a respective one of said three conveying segments, said suction boxes having guide elements for said conveyor belt;

an apparatus for adjusting a height of a central said suction box in a direction of the print head and said guide element assigned to said central conveying segment opposite the print head in accordance with a thickness of the sheets, for setting a spacing distance between a surface of a sheet to be printed and the print head, said central suction box being connected to the adjacent said suction boxes in an articulated manner, said adjacent suction boxes being pivotally mounted and articulated about respective pivot axes coaxially aligned in each case with a rotational axis of a respective said deflection roller.

2. The device according to claim 1, wherein said apparatus for adjusting said guide element opposite the print head includes a lever mechanism.

3. The device according to claim 1, wherein said apparatus for adjusting said guide element opposite the print head includes rollers for vertically guiding said guide element.

* * * * *